US007597111B2

(12) United States Patent
Bauer

(10) Patent No.: US 7,597,111 B2
(45) Date of Patent: Oct. 6, 2009

(54) PORTABLE PAINTING TENT

(76) Inventor: Daryl Bauer, 14942 Prescott Rd., Manteca, CA (US) 95336

( * ) Notice: Subject to any disclaimer, the term of this patent is extended or adjusted under 35 U.S.C. 154(b) by 0 days.

(21) Appl. No.: 11/606,615

(22) Filed: Nov. 29, 2006

(65) Prior Publication Data

US 2008/0121261 A1 May 29, 2008

(51) Int. Cl.
*E04H 15/02* (2006.01)

(52) U.S. Cl. ..... 135/96; 135/139; 135/152; 135/120.1

(58) Field of Classification Search ..... 135/90, 135/96, 117, 123, 139, 141, 152, 156, 902, 135/905; 118/DIG. 7; 269/901, 905; 454/50, 454/51, 52; 160/350, 351; 211/95
See application file for complete search history.

(56) References Cited

U.S. PATENT DOCUMENTS

| | | | | | |
|---|---|---|---|---|---|
| D55,384 | S | * | 6/1920 | Kingsbury et al. | D6/347 |
| 2,729,844 | A | * | 1/1956 | Weiss | 15/308 |
| 2,755,009 | A | * | 7/1956 | Parker | 182/129 |
| 3,327,376 | A | * | 6/1967 | Freeman et al. | 29/225 |
| 3,570,507 | A | * | 3/1971 | Kashuba | 135/123 |
| 4,111,408 | A | * | 9/1978 | Love | 269/289 R |
| 4,129,217 | A | * | 12/1978 | Campbell | 211/95 |
| 4,231,289 | A | * | 11/1980 | Domicent | 454/52 |
| 4,532,886 | A | * | 8/1985 | Bouchard | 118/326 |
| 4,682,448 | A | * | 7/1987 | Healey | 52/63 |
| 4,770,088 | A | * | 9/1988 | Kistner | 454/50 |
| 4,932,354 | A | * | 6/1990 | Kistner | 118/305 |
| 4,941,427 | A | * | 7/1990 | Houssian | 118/326 |
| 5,088,511 | A | * | 2/1992 | Bain | 134/200 |
| 5,090,648 | A | * | 2/1992 | Wood, IV | 248/125.3 |
| 5,551,980 | A | * | 9/1996 | Turnbo | 118/500 |
| 5,894,945 | A | * | 4/1999 | Curran | 211/162 |
| 6,178,978 | B1 | * | 1/2001 | Rieber | 135/96 |
| 6,875,277 | B1 | * | 4/2005 | Edgerton | 118/500 |
| 7,004,932 | B2 | * | 2/2006 | Szurko | 604/289 |
| 7,172,512 | B2 | * | 2/2007 | Be | 472/118 |

* cited by examiner

*Primary Examiner*—David Dunn
*Assistant Examiner*—Patrick Lynch
(74) *Attorney, Agent, or Firm*—GSS Law Group

(57) ABSTRACT

A portable painting tent comprises a tall tripod frame with telescoping legs over which is draped a tent to control paint spray. Inside at the apex of the tripod, a swivel allows a standard house door, or other large items, to be hung from its top edge. A special bracket attaches to the top of the item, where it can be left unpainted, and the whole clips into a slot in the swivel. Both sides and edges of the item can be spray painted, and special handles are used to pick the wet item off the swivel and put it somewhere for drying. The whole tent can be folded up and carried away by collapsing the telescoping legs and folding them together in a tight bundle.

3 Claims, 3 Drawing Sheets

Fig. 2A
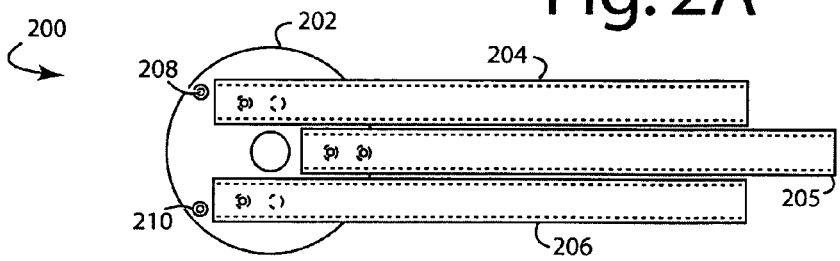
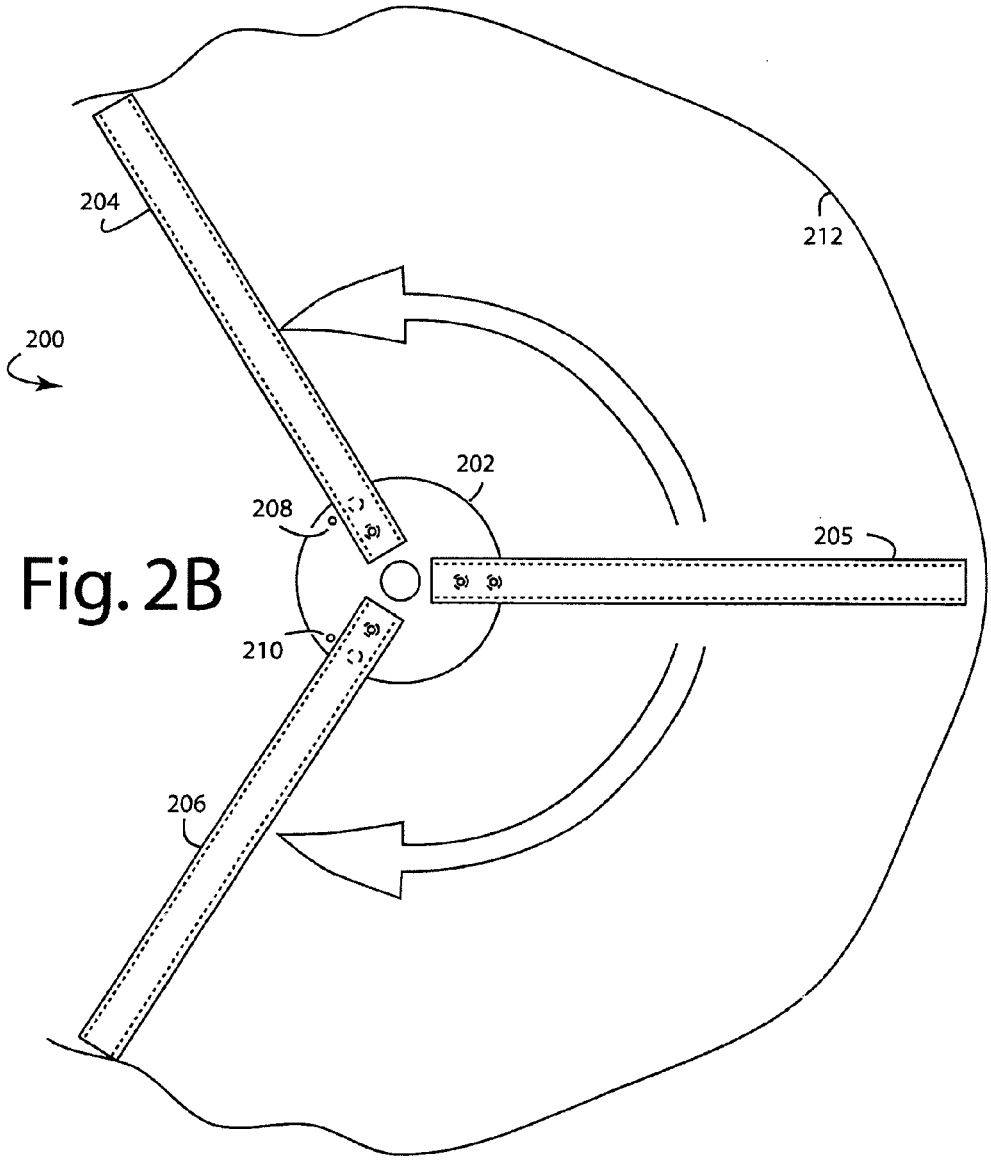
Fig. 2B

PORTABLE PAINTING TENT

FIELD OF THE PRESENT INVENTION

The present invention relates to painting tools, and in particular to portable paint spraying booths suitable for on-site painting of house doors.

BACKGROUND

Painting can always be messy, and spray painting can especially be troublesome with its overspray that seems to get everywhere. Finished houses have floors, carpets, walls, furniture, and such that need protection from paint spray if it's to be done inside. One way to protect them is to bag or cover the collateral objects, the other way is to remove or enclose the paint spraying in a booth.

Aside from the problems of overspray, painting big items like doors is not so easy. They are large, awkward, and sometimes very heavy. All sides and edges need to be painted, and that leaves nowhere to grip or support the door until it's dry.

What is needed is a way to paint items on-site and easily, to control any overspray, and to be able to pick up a wet item and to put it somewhere else to dry.

SUMMARY OF THE PRESENT INVENTION

Briefly, a portable painting tent embodiment of the present invention comprises a frame with telescoping legs over which is draped a tent to control paint spray. Inside at the apex of the frame, a swivel allows an item-to-be-painted to be hung from its top edge. A special bracket attaches to the top of the item, where it can be left unpainted, and the whole clips into a slot in the swivel. The sides and edges of the item can be spray painted. The whole tent can be folded up and carried away by collapsing the telescoping legs and folding them together in a tight bundle.

The method of use includes the steps: erecting a portable tent with a swivel inside at the top center; hooking a house door onto said swivel secured by a hanger bar coupled onto the top edge at the center where the door can be left unpainted; and spray painting the door within and turning it on said swivel to get to both sides and edges through an opening in said portable tent.

An advantage of the present invention is a painting tent is provided that is effective and easy to use.

Another advantage of the present invention is a painting tent is provided that is portable, easy to erect, and easy to fold-up and carry away to the next job.

A further advantage of the present invention is a painting tent is provided that allows all sides of a house door to be spray painted in one operation.

The above summary of the present invention is not intended to represent each disclosed embodiment, or every aspect, of the present invention. Other aspects and example embodiments are provided in the figures and the detailed description that follow.

BRIEF DESCRIPTION OF THE DRAWINGS

The present invention may be more completely understood in consideration of the following detailed description of various embodiments of the present invention in connection with the accompanying drawings, in which:

FIGS. 2A and 2B, respectively, are folded and unfolded views of the top of a tripod and a surrounding cover like that of FIG. 1.

Figure 1:
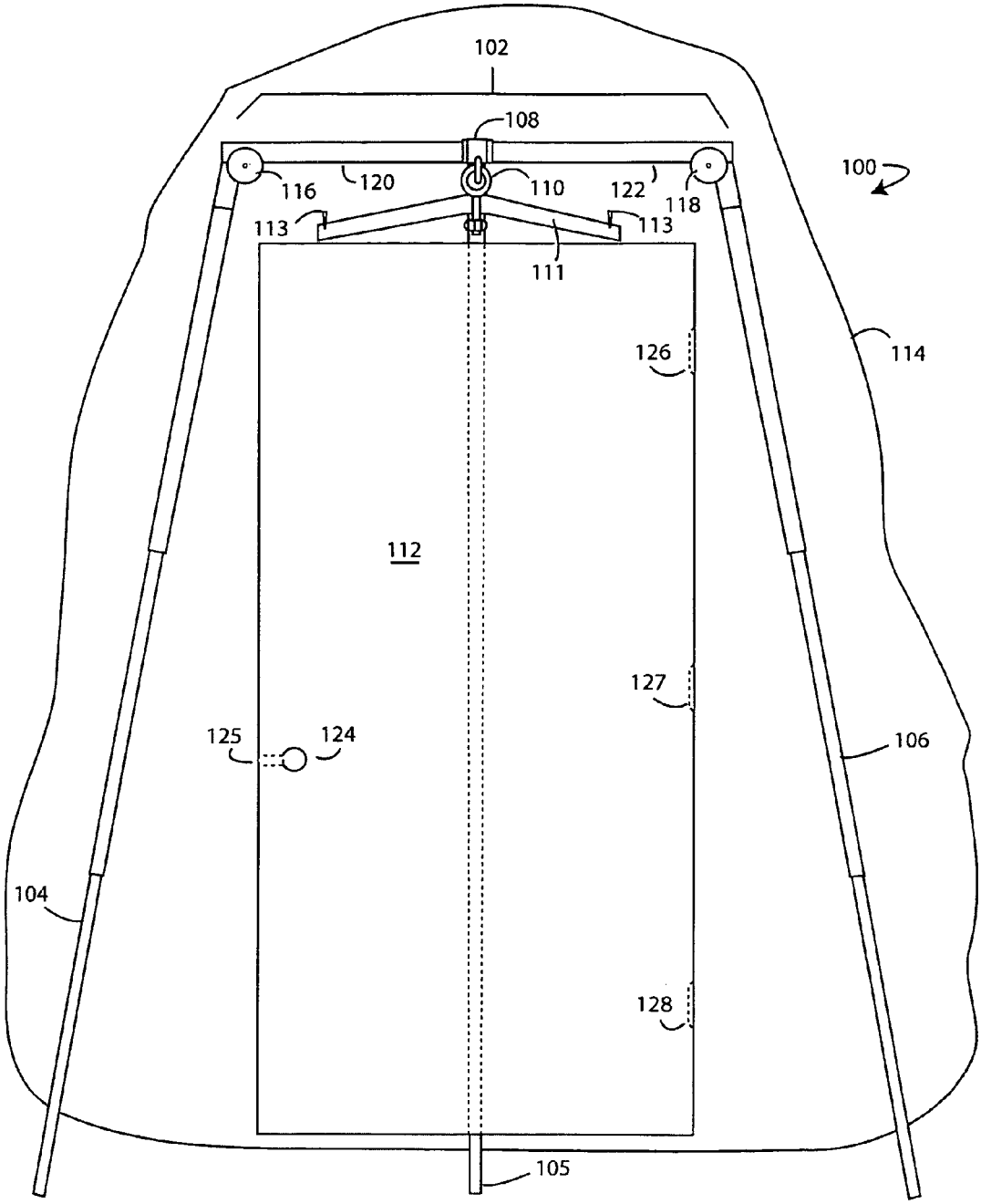
FIG. 1 is a side view diagram of portable painting tent embodiment of the present invention ready to paint a house door hanging inside.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention as defined by the appended claims.

DETAILED DESCRIPTION

The invention includes a portable painting tent. In the example embodiment discussed herein, the painting tent includes a frame with telescoping legs over which is draped a tent to control paint spray. In preferred embodiments, the frame includes three legs, but in other embodiments more than three legs may be used. Inside at the apex of the tent, a swivel allows an item-to-be-painted to be hung from its top edge. In some embodiments, a special bracket attaches to the top of the item, where it can be left unpainted, and the whole clips into a slot in the swivel. The sides and edges of the item can be spray painted. The whole tent can be folded up and carried away by collapsing the telescoping legs and folding them together in a tight bundle.

Turning now to the figures, FIG. 1 shows a portable painting tent embodiment of the present invention, and is referred to herein by the general reference numeral 100. The painting tent 100 comprises a tripod 102 with telescoping legs 104-106 and a swivel hook 108. In other embodiments more than three legs may be used. An eye bolt 110 hooks up under the swivel hanger 108. Such eye bolt 110 fits into a door hanger bar 111 attached to a house door 112 using wood screws 113. Other means for holding the item to be painted may be included.

Many kinds of items besides doors can also be painted inside tent 100. A shroud or cover 114 drapes over tripod 102 and controls overspray when spray painting, for example, door 112. Plastic sheeting is placed below on the floor. The swivel hanger 108 and door hanger bracket 110 allow the painter to get to the front, back, and sides of the door for spraying paint. Elbows 116 and 118, and a third one not shown in FIG. 1, allow the legs 104-106 to be folded up and tucked under arms 120 and 122 for storage. A third arm is not shown in FIG. 1. The door 112 typically includes a door knob hole 124, a lockset bore 125, and three relief's 126-128 for the hinge plates.

FIGS. 2A and 2B illustrate the folding and storage mechanisms of painting tent 100. A tripod 200 comprises a hub 202 and three arms 204-206 for telescoping tripod legs, e.g., legs 104-106 (FIG. 1). Arm 205 is fixed to hub 202 with a couple of fasteners. But arm 204 and 206 can be rotated out against snap pins 208 and 210. FIG. 2A shows the arms 204 and 206 folded for storage, and FIG. 2B shows them folded out for use as in FIG. 1. In FIG. 2B, a cover 212 is represented as shrouding ⅔ of the volume inside.

In a method embodiment of the present invention, a painting tent like those of FIGS. 1, 2A, and 2B, is erected. This is done by rotating the three legs 104-106 down until they hit a stop. A pin in elbows 116, 118, locks the legs 104-106 in position on horizontal arms 120, 122 (also 204-206). Referring to FIGS. 2A and 2B, the arms 204 and 206 are rotated out on the hub 202 until they lock against snap pins 208 and 210. The telescoping legs 104-106 are all then extended until they also snap into position. The cover 114, 212, is draped over the whole frame tripod 102, 200, and secured with clips. A plastic sheet is typically placed on the floor underneath the painting tent 100.

The embodiment disclosed herein is particularly suited for painting doors. When painting doors, the door 112 has typically been removed from its hinges for painting. When the door 112, eye bolt 110, and hanger bar 111 have been lifted off swivel hook 108 after painting, the whole can be leaned up against a wall for drying without the paint on door 112 coming into contact with the wall. After drying, the fasteners 113 and hanger bar 111 can be removed and used again on the next door to be painted.

In the case where a house door is to be painted, the hanger bar 111 is screwed with self-tapping screws 113 to the top edge of the door 112, e.g., at the center of the top edge of the door where it will balance and hang straight. The door 112 and hanger 110 are then lifted so they can be hooked into a slot on hanger swivel 108. The door 112 can then be spray-painted, and the swivel 108 allows it to be freely spun around. The cover 114 will catch under-spray, and a 120-degree front opening allows easy access. The top of the door where the hanger bracket attaches can be left unpainted as no one typically sees that area after the door is installed; and Any of a number of obvious ways can be devised to construct and attach swivel 108 and hanger bar 111. So the details are unimportant here. These items, however, must be strong enough to support the weight of a door be reusable, and jointed appropriately to provide a hooking action followed by a swivel action.

Very often a freshly painted door cannot be left hanging inside until the paint dries. It needs to be lifted off and moved someplace where it will remain undisturbed, e.g., overnight in a dust-free, quiet area. A frequent problem encountered is how to pick up a door when there is wet-paint on every grip location.

Figure 3:
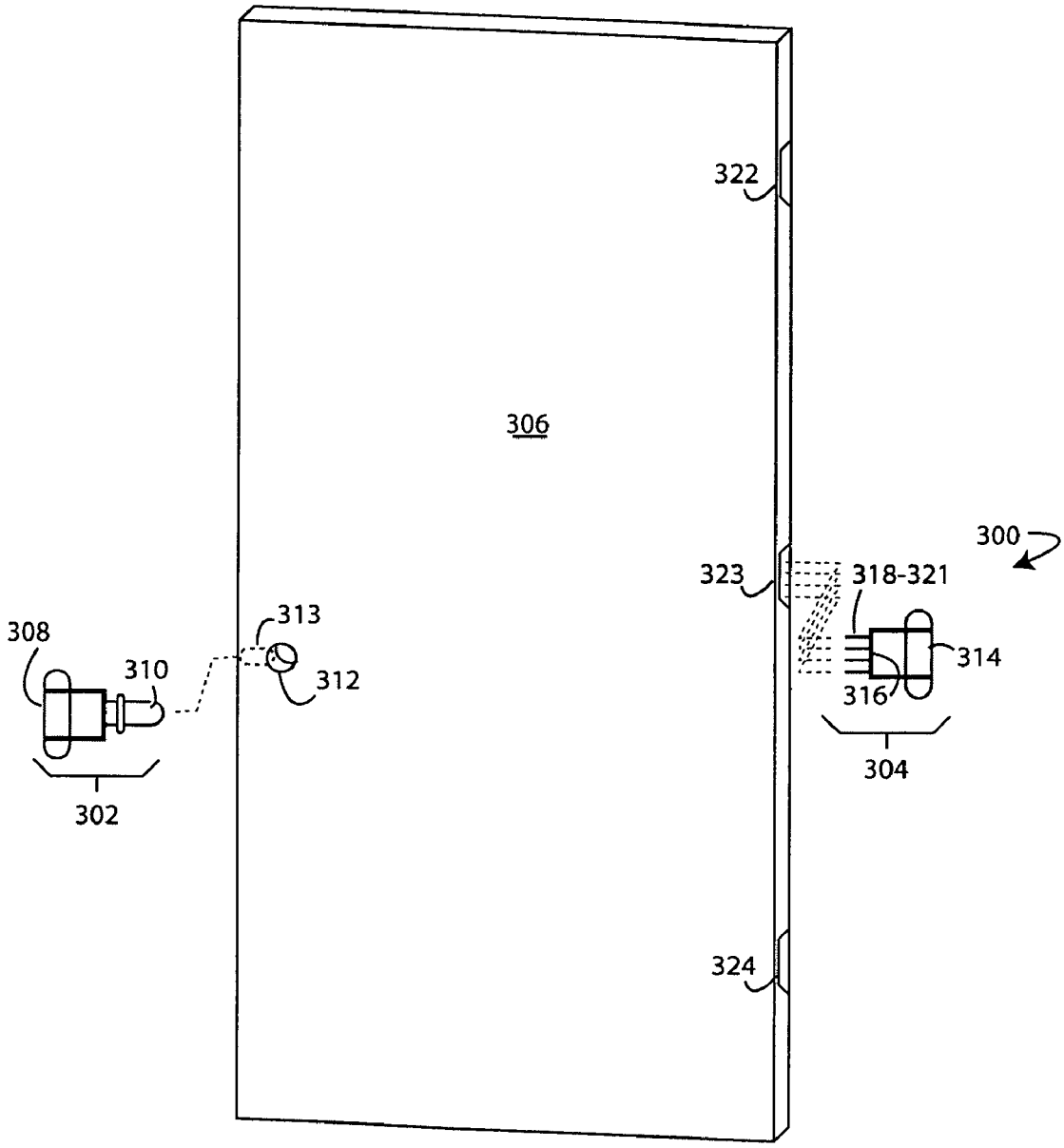
FIG. 3 is a perspective view diagram of a wet, painted door and handles that can be used to remove it from the portable painting tents shown in FIGS. 1, 2A, and 2B.

FIG. 3 illustrates a system 300 comprising a pair of grips 302 and 304 for handling a typical door 306 with wet painted surfaces. The first grip 302 has a handle 308 for lifting and a large pin 310 that slips snuggly into a door knob hole 312 or lockset bore 313 on the door 306. The second grip 304 also has a handle 314 for lifting and a plate 316 with several sharp spikes 318-321 that spear into any of hinge plate areas 322-324.

While the present invention has been described with reference to several particular example embodiments, those skilled in the art will recognize that many changes may be made thereto without departing from the spirit and scope of the present invention, which is set forth in the following claims.

The invention claimed is:

1. A portable painting tent system comprising:

a tripod frame with legs enclosing a volume to hang and turn a house door within said tripod, a swivel attached at a center of said tripod where said legs converge, and providing for a swivel joint on which a hanging door may be turned for painting, a hub for accepting support provided by said legs and for supporting said swivel, a set of horizontal arms each attached at said at said hub at a first end and to a corresponding leg at a second end, whereby an overall height of said tripod can accommodate doors for painting within, a set of elbows coupling said legs to said horizontal arms, a bracket for attaching to a top of said door and including means for hooking onto said swivel, a cover draped over an outside of said tripod providing for control; of paint over-spray when painting said door hanging inside said tripod, a first grip handle for insertion into an empty door lockset bore after said door is painted painting tent; and a second grip having spikes for spearing hinge plate areas of said door;

wherein, said legs include telescoping means, and wherein said tripod may be folded for storage and for carrying, and wherein a freshly painted door can be lifted by both the first and second grips, without disturbing the wet painted surfaces, and un-hooked from said swivel to be placed elsewhere for drying.

2. The painting tent of claim 1, wherein the hub allows two of said three horizontal arms to be folded up against the third of said three horizontal arms, to the allow said frame to be folded up for storage.

3. The painting tent of claim 1, further comprising:

a hanger bar that attaches to a top edge of a door, and that supports a weight of said door while hanging from said swivel.

* * * * *